US005660008A

United States Patent [19]

Bevilacqua

[11] Patent Number: 5,660,008

[45] Date of Patent: Aug. 26, 1997

[54] TRIANGULAR SHAPED PIPE FOR USE IN CRAWL SPACES

[76] Inventor: Joseph Bevilacqua, 436 N. Derry Rd., Loyalhanna, Pa. 15661

[21] Appl. No.: 582,944

[22] Filed: Jan. 4, 1996

[51] Int. Cl.[6] ..... E02D 19/00

[52] U.S. Cl. ..... 52/169.5; 52/169.13; 52/302.3; 52/732.2; 138/92; 138/157; 138/163; 138/DIG. 8

[58] Field of Search ..... 52/169.5, 169.13, 52/292, 293.2, 302.1, 302.3, 720.1, 731.2, 731.7, 732.1, 732.2; 138/92, 120, 156, 157, 162, 163, DIG. 8

[56] References Cited

U.S. PATENT DOCUMENTS

| | | | |
|---|---|---|---|
| 87,694 | 3/1869 | McLutes | 138/157 X |
| 265,716 | 10/1882 | Taylor | 138/163 |
| 854,397 | 5/1907 | Beach et al. | 138/157 |
| 1,499,954 | 7/1924 | Stiles | 138/157 |
| 1,508,347 | 9/1924 | Montreuil | 138/157 |
| 1,750,833 | 3/1930 | Carns | 52/720.1 |
| 3,126,444 | 3/1964 | Taylor | 138/163 X |
| 3,287,866 | 11/1966 | Bevilacqua | 52/302.3 |
| 4,011,726 | 3/1977 | Cooper, Jr. | 138/157 X |
| 4,590,722 | 5/1986 | Bevelacqua . | |
| 5,379,567 | 1/1995 | Vahey | 52/731.2 X |
| 5,426,906 | 6/1995 | McCracken | 52/731.2 X |
| 5,483,782 | 1/1996 | Hall | 52/731.7 X |

*Primary Examiner*—Carl D. Friedman
*Assistant Examiner*—Kevin D. Wilkens

[57] ABSTRACT

An apertured drainage pipe including a first section being inverted V-shaped and a second section, the second section being substantially flat, the second section having a first turn-up and a second turn-up to receive the first section. The drainage pipe is used with a drainage apparatus for a basement having a outer wall and footer unit and a floor including the outer wall and footer unit having an open area excavation at the inner margin thereof extending from the lower margin of the wall footer unit up to a level above the footer, the outer wall having vertically extending openings therein that are aligned, the drainage apparatus including an excavation in which the drainage pipe is placed and spaced from the footer, the outer wall draining water therefrom into the excavation, the drainage pipe enabling water to flow therethrough from the excavation, and gravel filler to fill in the excavation around the drainage pipe and support the floor.

11 Claims, 2 Drawing Sheets

TRIANGULAR SHAPED PIPE FOR USE IN CRAWL SPACES

BACKGROUND OF THE INVENTION

1. Field of Invention

This invention pertains generally to the art of apparatuses to drain and waterproof basements, and more specifically to an improved drainage pipe to be used to drain water from a basement.

2. Description of the Related Art

Past drainage pipes for basement waterproofing systems have been effective but can be sometimes difficult to assemble or are susceptible to breakage of the plastic pipe during shippage or assemblage of the pipe.

U.S. Pat. No. 4,590,722 to Bevilacqua discloses two types of drainage pipes. The first is a fully molded piece. The fully molded piece may not be nested with other pipes and can be fragile. The pipes are necessarily long, and the void areas in the pipes can make them susceptible to breakage. The second pipe disclosed is a two piece pipe with an U-shaped bottom and a top piece fitted with flanges to hold the bottom piece. The U-shaped bottoms also are not easily nested with other pieces and are susceptible to breakage during assembly of the pipe.

Applicant recognized the need for an improved pipe design that was easier to transport and less susceptible to breakage during the assembly process.

The present invention contemplates a new and improved drainage pipe for use with a basement waterproofing system which is simple in design, effective in use, and overcomes the foregoing difficulties and others while providing better and more advantageous overall results.

SUMMARY OF THE INVENTION

In accordance with the present invention, a new and improved drainage pipe for use with a basement waterproofing system is provided which is easy to transport, easy to assemble, and provides greater ability to support heavy loads in small areas such as crawl spaces.

More particularly, in accordance with the present invention, a drainage pipe includes a first section which is shaped like an inverted letter "V" and a second section which is substantially flat. The second section has a length and a width. The second section has a first edge along the length of the second section and a second edge along the length of the second section. The first edge and the second edge are folded over to receive the first section.

According to one aspect of the invention, the first section of the drainage pipe has apertures.

According to another aspect of the present invention, a drainage apparatus for a basement having a outer wall and footer unit and a floor including the outer wall and footer unit having an open area excavation at the inner margin thereof extending from the lower margin of the wall footer unit up to a level above the footer, the outer wall having vertically extending openings therein that are aligned, the drainage apparatus includes an apertured drainage pipe in the excavation and being spaced from the footer, the outer wall draining water therefrom into the excavation, the drainage pipe enabling water to flow therethrough from the excavation. The drainage apparatus also includes gravel filler to fill in the remainder of the excavation and to support the drain pipe and the floor above the drain pipe.

One advantage of the present invention is its ability to be easily transported in nested combinations.

Another advantage of the present invention is its ability to be withstand large vertical loads, such as are often present in crawl spaces.

Another advantage of the present invention is its ability to be easily assembled without the use of tools.

Another advantage of the present invention is its ability to be easily assembled without the pounding or hammering.

Another advantage of the present invention is the improved design without breakable parts.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
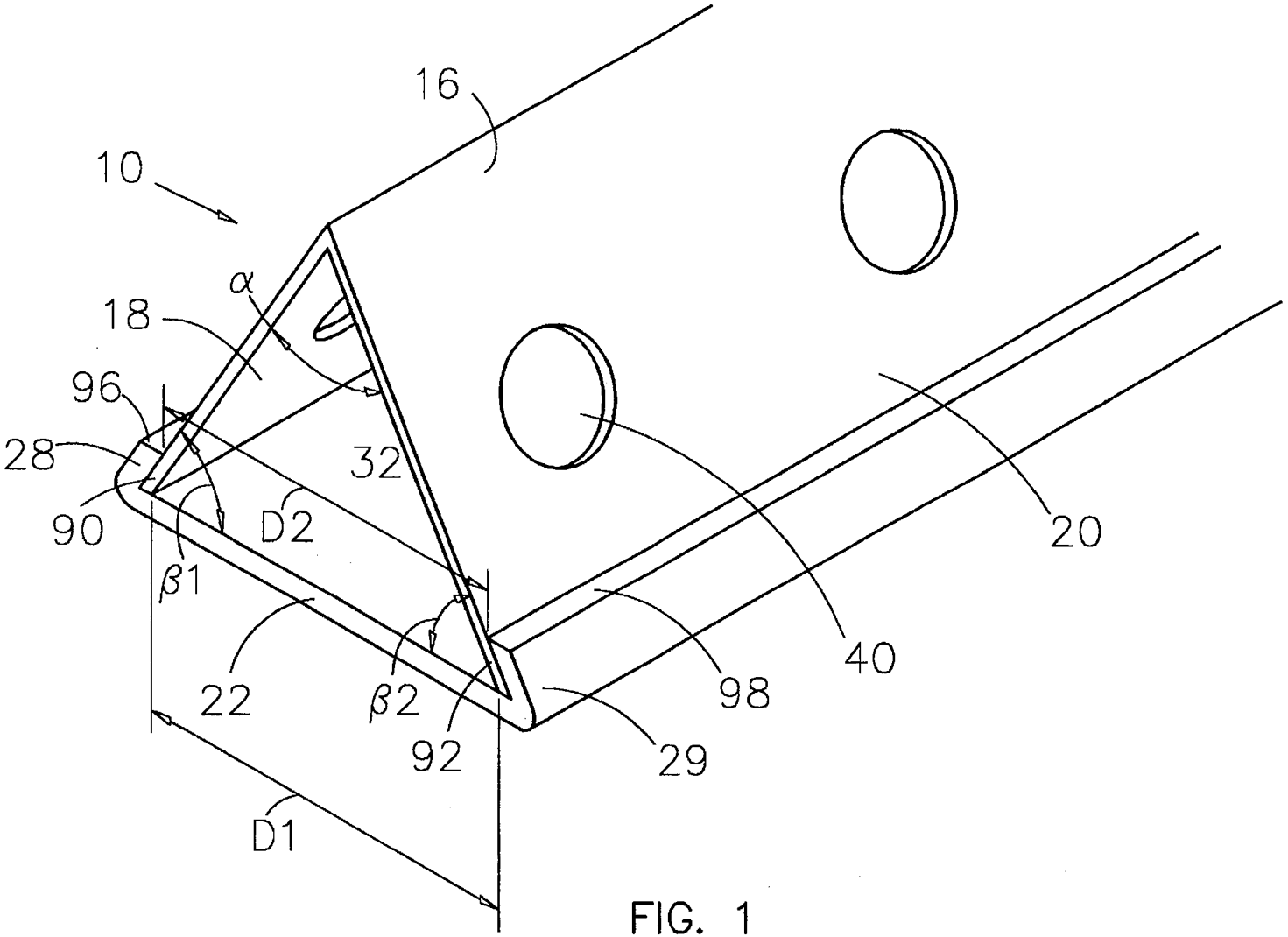
FIG. 1 shows a triangular drain pipe.

Referring now to the drawings, which are for purposes of illustrating a preferred embodiment of the invention only, and not for purposes of limiting the same, FIG. 1 shows an assembled pipe 10. The pipe 10 consists of a V-shaped upper section 16 and a lower section 22.

In the preferred orientation, the upper section 16 is arranged as indicated in FIG. 1, where the "V" is inverted. The upper section 16 is includes first and second legs 18,20 and an included angle $\alpha$ therebetween. $\alpha$ is between 30 degrees and 75 degrees, but is preferably equal to 60 degrees.

The lower section 22 has turn-up sections 28,29 that are turned upwardly and inwardly. The turn-up sections 28,29 make and angles $\beta 1$ and $\beta 2$, respectively, with a bottom surface 32 of the lower section 22. $\beta 1$ and $\beta 2$ are between 30 degrees and 75 degrees, but are preferably equal to 60 degrees. As such, along with $\alpha$, $\beta 1$ and $\beta 2$ are preferably equal to 60 degrees, making the cross-sectional shape of the assembled pipe 10 to be an equilateral triangle.

When the pipe 10 is assembled, the turn-ups 28,29 hold the V-shaped upper section 16 in place. The pipe 10 is assembled by resiliently deforming first and second legs 18,20 of the V-shaped upper section 16 inwardly so that the legs 18,20 of the V-shaped upper section 16 fit between the turn-ups 28,29 of the lower section 22. The resilient deformation is caused by manually-generated forces, for example by the hands of the installer of the pipe. The legs 18,20 are resiliently deformed inwardly until a distance D1 between edges 90,92 of the legs 18,20 is less than a distance D2 between edges 96,98 of the first and second turn-ups 28,29.

When the legs 18,20 of the upper section 16 clear the turn-ups 28,29, the manually generated pressure is released and the turn-ups 28, 29 hold the V-shaped upper section 16 against the lower section 22.

The drainage pipe 10 has a series of apertures 40 that are lined up along the lower end of the inverted V-shaped upper section 16. The apertures 40 are preferably circular, located between 1.0 inches and 12.0 inches apart, and have a diameter between 0.25 inches and 2.0 inches. The preferred embodiment has apertures with diameters of 1 inch and are which are spaced about three inches apart. Water flows into the drainage pipe 10 through the apertures 40 and passes through the pipe 10 on a bottom surface 32 of the lower section 22, and eventually to a desired location. The bottom surface 32 is between 2.0 inches and 12.0 inches wide, but is preferably about 4.0 inches wide.

Figure 2:
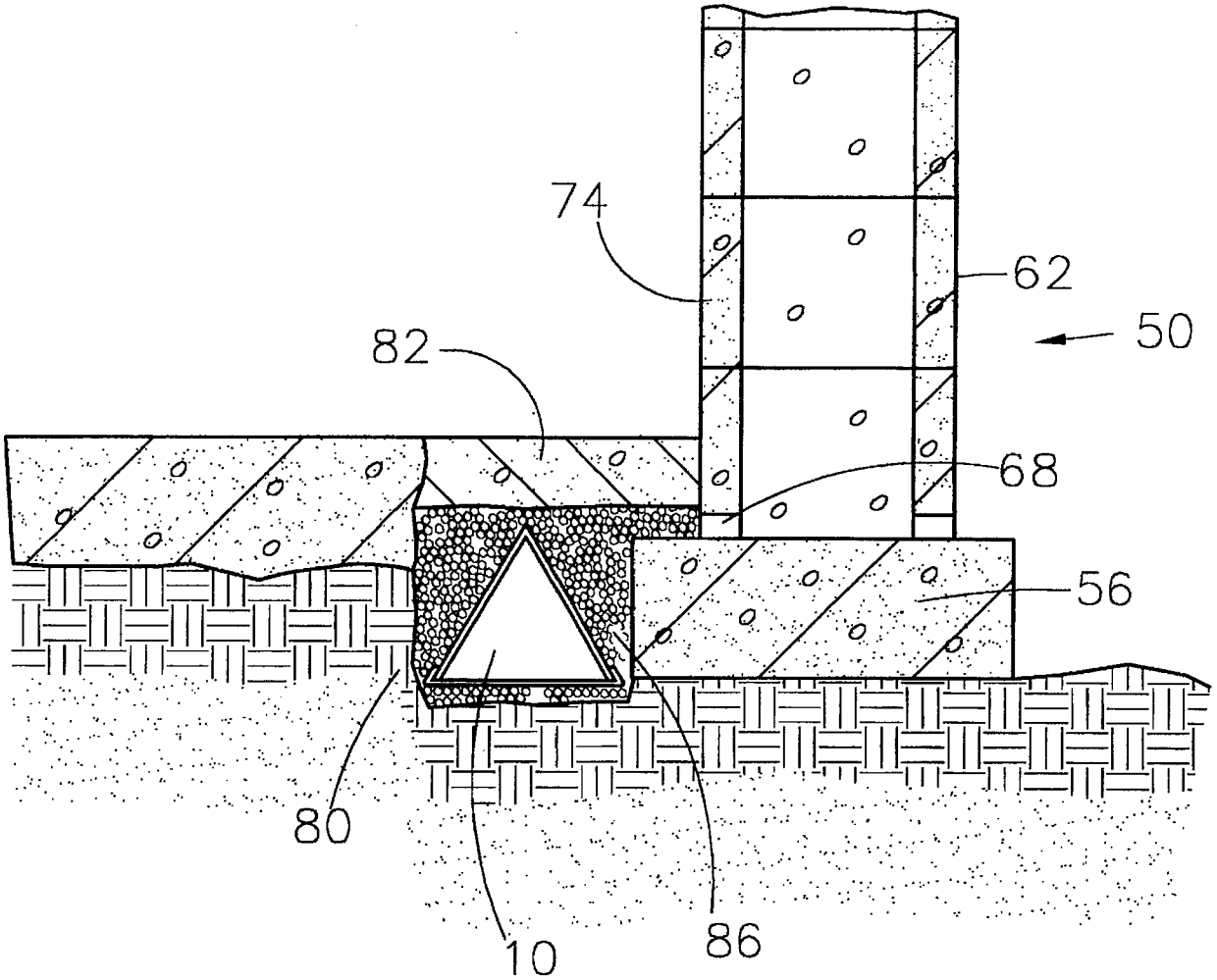
FIG. 2 shows a basement waterproofing system utilizing the triangular drain pipe.

The pipe 10 is preferably used with a wall and foundation drainage system, such as that disclosed in U.S. Pat. No. 4,590,722 to Bevelacqua, which is incorporated herein by reference. FIG. 2 shows the drainage pipe 10 as used in a basement waterproofing system 50 applied to a conventional wall and foundation assembly. Although the invention is being described with reference a block wall, the invention can be successfully practiced with any kind of wall, including but not limited to block, tile, cement, etc. The foundation has a footer 56 and building blocks 62 that make up the wall in a conventional manner. The blocks 62 can have open centers vertically aligned in the wall whereby any moisture coming into the center portion of the wall will flow down therethrough and can be drained from the wall through a plurality of openings or slots 68 that are formed in an inner wall surface 74 so these portions in the inner wall surfaces 74 of the blocks 62 communicate from the interior of the building blocks 62 to form drainage openings adjacent an excavation 80 which is formed in any suitable manner adjacent the inner wall of the wall footer 56. Thus, water can flow out through the slot 68 over the upper surface of the footer 56 and down into this excavation 80.

The drainage pipe 10 is laid in the excavation 80 and serves to drain the area 80 of water. Water entering the excavation 80 enters the drainage pipe 10 through the apertures 40 (see FIG. 1) and flows from the basement in a conventional manner.

The configuration of the inventive drainage pipe 10, namely its triangular nature, makes it is stronger than other conventional similar types of pipe, and it requires less room in the excavation 80. The inventive drainage pipe 10 is particularly well-suited for use in crawl spaces where room is limited and vertically directed weight loads are increased. Such vertically directed loads in crawl spaces are often due to heavy objects placed in such crawl spaces, such as tractors, tools, mechanized equipment, and the like.

The area of excavation 80 around the drainage pipe 10 is filled in with gravel 86 or any other suitable substance that water is free to pass through to reach the drainage pipe 10.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A drainage pipe, said drainage pipe comprising:

a first section, said first section having first and second legs and an included angle $\alpha$ therebetween, said first section having apertures;

a second section, said second section being substantially flat, said second section having a first turn-up and a second turn-up, said first section being selectively assembleable to said second section by said first leg being fit against said first turn-up and said second leg being fit against said second turn-up; and said first and said second legs of said first section of said pipe are capable of being resiliently deformed inwardly.

2. The drainage pipe of claim 1 wherein said apertures have a diameter between 0.25 inches and 2.0 inches.

3. The drainage pipe of claim 2 wherein said apertures have a diameter of 1.0 inch.

4. The drainage pipe of claim 1 wherein said apertures are spaced between 1.0 inches and 12.0 inches apart.

5. The drainage pipe of claim 4 wherein said apertures are spaced 3.0 inches apart.

6. The drainage pipe of claim 1 wherein said first section and said second section of said pipe are capable of being assembled by resiliently deforming inwardly said first and second legs of said first section until a first distance between an edge of said first leg and an edge of said second leg is less than a second distance between an edge of said first turn-up and said second turn-up.

7. The drainage pipe of claim 1 wherein said second section has a width between 4.0 inches and 8.0 inches.

8. The drainage pipe of claim 1 wherein said angle $\alpha$ is approximately 60 degrees.

9. The drainage pipe of claim 1 wherein a cross-sectional shape of said pipe is an equilateral triangle.

10. A drainage apparatus associated with a basement having an associated outer wall, an associated footer unit, and a floor including said outer wall and footer unit having an open area excavation at an inner margin thereof extending from a lower margin of said wall footer unit up to a level above said footer, said drainage apparatus comprising:

an apertured drainage pipe being spaced from said footer, said outer wall draining water therefrom into said excavation, said drainage pipe enabling water to flow therethrough from said excavation, said drainage pipe being apertured and formed of sections operatively connected together, said drainage pipe having a cross-section of open center triangular shape in vertical section, said sections including an inverted V-shaped upper section and a substantially flat lower section engageable with a lower end of said upper section, said lower section having engaging means for engaging said upper section lower end.

11. The drainage apparatus of claim 10 wherein said excavation is filled with gravel around said drainage pipe.

* * * * *